US005344180A

United States Patent [19]

Lancon et al.

[11] Patent Number: 5,344,180

[45] Date of Patent: Sep. 6, 1994

[54] SAFETY SKI BINDING

[75] Inventors: Bruno Lancon, Villy le Polloux; Pierre Desarmaux, Evires; Jean-Francois Merino, Annecy, all of France

[73] Assignee: Salomon S.A., Courbevoie, France

[21] Appl. No.: 98,831

[22] Filed: Jul. 29, 1993

[30] Foreign Application Priority Data

Jul. 31, 1992 [FR] France ..... 92 09513

[51] Int. Cl.[5] ..... A63C 9/08

[52] U.S. Cl. ..... 280/625; 280/626; 280/634

[58] Field of Search ..... 280/625, 626, 628, 634, 280/636

[56] References Cited

U.S. PATENT DOCUMENTS

| | | | |
|---|---|---|---|
| 4,336,956 | 6/1982 | Richert et al. | 280/625 |
| 4,516,792 | 5/1985 | Scheck et al. | 280/625 |
| 4,735,435 | 4/1988 | Hornschemeyer et al. | 280/625 |
| 4,984,816 | 1/1991 | Ruiller | 280/625 |
| 5,040,821 | 8/1991 | Berthet et al. | 280/625 |

FOREIGN PATENT DOCUMENTS

| | | | |
|---|---|---|---|
| 0415006 | 3/1991 | European Pat. Off. | 280/625 |
| 2905837 | 8/1980 | Fed. Rep. of Germany . | |
| 3230187 | 2/1984 | Fed. Rep. of Germany . | |
| 2625911 | 7/1989 | France . | |
| WO91/08808 | 6/1991 | PCT Int'l Appl. . | |

*Primary Examiner*—Margaret A. Focarino
*Assistant Examiner*—Carla Mattix
*Attorney, Agent, or Firm*—Pollock, Vande Sande & Priddy

[57] ABSTRACT

Safety ski binding designed to hold releasably in position the front portion of a boot (2) mounted on the ski (3), comprising a forward fall-compensation mechanism comprising a pedal (12) forming a forward fall sensor. The front end (12*a*) of the pedal (12) is, in the pedal rest position, positioned at a distance (d) above a moveable control element (9) which approximates the standard tolerance for the thickness of the sole (6) of the boot, i.e., by a distance between accepted maximum and minimum thicknesses of the sole (6).

4 Claims, 1 Drawing Sheet

SAFETY SKI BINDING

FIELD OF THE INVENTION

The present invention concerns a safety ski binding designed to hold releasably in place the front of a boot mounted on the ski.

BACKGROUND OF THE INVENTION

Safety ski bindings are already known, still called "front stop" bindings, which comprise a body mounted on a seating attached to the ski, this body carrying, in its rear part, a boot position-retention jaw incorporating two lateral position-retention wings set opposite each other, and an energy-generating mechanism housed in the body, which elastically returns the jaw to the locked position. This energy mechanism comprises an energy spring whose tension is adjustable, of which one end is supported on a bearing surface connected to the body, and whose other end is supported on a stress-transmission device longitudinally movable in the body and coupled to the jaw, so as to push elastically under stress this jaw against the front of the boot, in order to ensure position-retention of the latter on the ski.

Among the many types of front stops known to date, the one described in applicant's Patent No. FR-A-2 640 516 further incorporates a forward fall-compensation mechanism comprising a pedal acting as a forward fall sensor and mounted on the ski behind the front stop, on which the front portion of the sole of the boot is supported and whose rear part is jointed to the ski around a horizontal, transverse axis. The extreme front part of this fall-sensor pedal is supported on the rear portion of a movable control element, such as a rocker device, which is incorporated into the front stop. The front part of this rocker device acts on the energy-generating mechanism so as to lower the lateral release threshold of the front stop, in the event the skier falls forward and twists his leg at the same time. This lowering of the release threshold of the front stop results from the pivoting motion of the rocker device as acted upon by pressure exerted by the front portion of the sole of the skier's boot on the forward fall-sensor pedal, in the event of a forward fall.

SUMMARY OF THE INVENTION

The present invention concerns improvements made to this type of front stop, in order to simplify the construction thereof, while using very simple means to adjust this stop to different sole thicknesses, by incorporation of the height-adjustment function into the forward fall-sensor pedal.

To this end, this safety ski binding designed to hold releasably in place the front of a boot mounted on the ski, comprises a body attached to the ski and carrying in its rear portion a boot position-retention jaw incorporating two lateral position-retention wings set opposite each other, an energy-generating mechanism housed in the body and serving to return the jaw elastically to the locked position, and a forward fall-compensation mechanism comprising a front fall-sensor pedal mounted on the ski to the rear of the front stop, whose rear portion is jointed to a seating attached to the ski around a horizontal, transverse axis, and which is returned upward into a pre-determined resting position by a spring and having a forward extension which, in the event that the skier falls forward, exerts a downward force on a movable control element, such as a rocker device, belonging to the forward fall-compensation mechanism and housed in the body of the front stop so as to lower the release threshold of this front stop. The binding is characterized by the fact that the front end of the pedal is, in the pedal-resting position, located above the movable control element at a distance which approximates the standard tolerance for the thickness of the boot sole, i.e., approximately the accepted distance between the maximum and minimum thicknesses of this sole.

BRIEF DESCRIPTION OF THE DRAWINGS

Several embodiments of the invention will be described below by way of example and with reference to the attached drawings, in which.

DESCRIPTION OF THE PREFERRED EMBODIMENT

Figure 1:
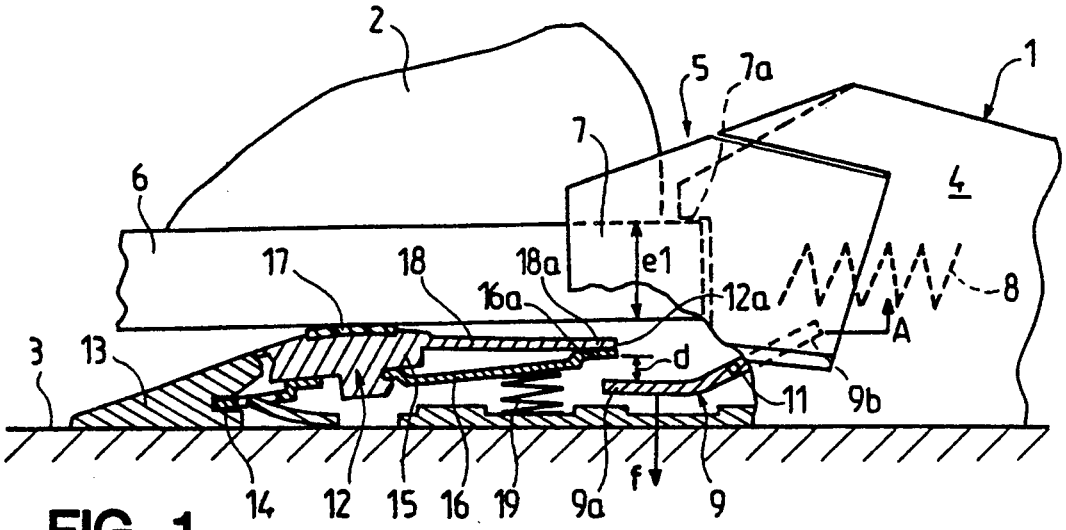
FIG. 1 is a vertical, longitudinal cross-section of a front stop according to the invention and fitted with an automatic height-adjustment device integrated into forward fall-sensor pedal, when a ski boot having a minimum sole thickness is held in place.
Figure 2:
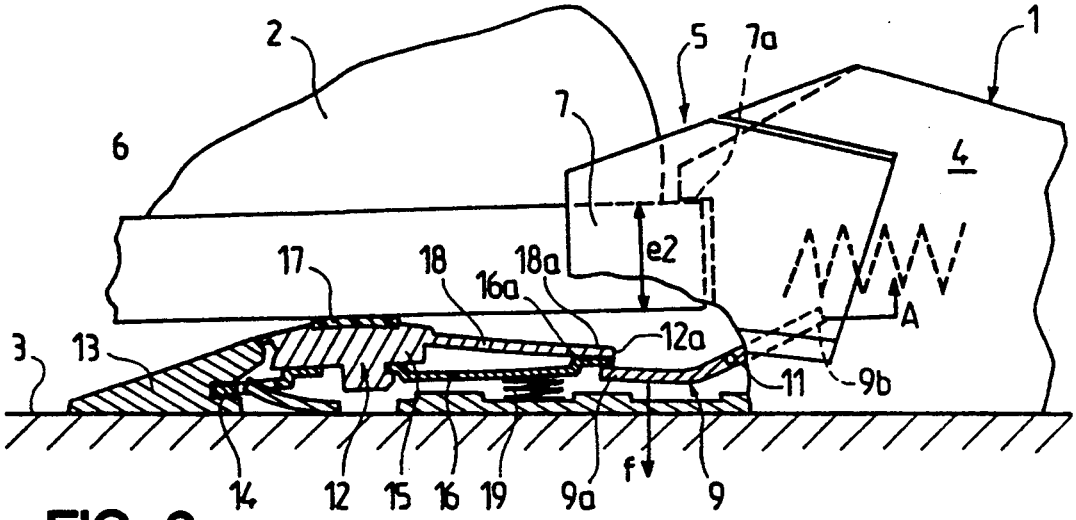
FIG. 2 is a vertical, longitudinal cross-section of the front stop in FIG. 1, adapted to hold in place a ski boot having a maximum sole thickness.

FIGS. 1 and 2 illustrate a safety or "front stop" binding 1 designed to hold in place the front portion of a ski boot 2 on a ski 3. The front stop 1 comprises a body 4, which is attached to a seating fastened to the ski. The rear portion of this body 4 comprises a jaw 5 designed to hold in place the edge of the sole 6 of the boot 2, which has a standard thickness that may vary between a minimal thickness e1 (boot shown in FIG. 1) and a maximum thickness e2 (boot illustrated in FIG. 2). The position-retention jaw 5 may be of any known type, and comprises two lateral position-retention wings 7 and a sole clamp 7*a* which returns the boot against vertical movement. The jaw 5 may be of one-piece construction, in which case the two lateral position-retention wings 7 form a single part, or else the jaw 5 may comprise two separate wings 7 mounted independently so as to pivot on the body 4 of the front stop 1. The jaw 5, and more specifically its lateral position-retention wings 7, are stressed elastically by an energy-generating mechanism of any conventional type housed with the body 4, illustrated schematically in the drawings by its spring 8 alone. This spring 8 is subjected to adjustable traction or compression pre-tensioning, so as to exert elastic stress on the lateral position-retention wings 7 against the sole 6 of the boot 2. The adjustable pre-tensioning of the spring 8 determines the lateral release threshold of the front stop when the skier's leg is subjected to a torsional stress.

The front stop according to the invention is provided with a fall-compensation mechanism, which makes it possible to attenuate the "hardness" of the front stop, i.e., to lower its release threshold in the event that skier falls forward while twisting his leg. The portion of the fall-compensation mechanism housed in the body 4 of the front stop 1 has not been illustrated in detail, and is shown schematically solely by a rocker device 9 jointed to the body 4 of the front stop 1 or on its seating around a horizontal, transverse axis 11. This rocker device 9, which is located in the central lower rear portion of the body 4, comprises a rear arm 9*a* extending substantially horizontally and longitudinally rearward, and a front arm 9b which, as indicated by the arrow A in FIGS. 1 and 2, acts on the energy-generating mechanism, so as to allow variation of the binding-release threshold.

The forward fall-compensation mechanism further comprises a pedal 12 forming a forward fall sensor, and on which the front part of the sole 6 of the boot 2 is supported. This pedal 12 is mounted movably on a base 13 attached to the ski rearwardly of the front stop 1, and extends longitudinally forward as a projection while its rear part pivots around a horizontal, transverse axis 14. The pedal is advantageously made in two parts, i.e., an upper support plate 15 made of a molded plastic, and an underlying metal frame 16. The upper support plate 15 of the pedal 12 carries, in its central portion, an anti-friction plate 17, made, for example, of polytetrafluoroethylene, on which the lower face of the sole 6 is effectively pressed. Furthermore, the upper support plate 15 of the pedal 12 comprises a front extension 18, constituted by a substantially horizontal tongue. The front end of this tongue 18 is positioned above and slightly in front of the rear end of the rear arm 9a of the rocker 9. The lower metal frame 16 has, at its rear end, a transverse part forming the pivoting axis 14 of the pedal 12. The frame 16 is attached to the support plate 15 of the pedal 12 and extends forward, beneath the upper tongue 18, its front end part 16a being located just beneath the front end part 18a of the tongue 18 and ending in the front end 12a of the pedal 12.

The pedal 12 is stressed upward by a compression spring 19 located between the base of the pedal and the front portion of the frame 16. In the raised resting position shown in FIG. 1, the pedal 12 is immobilized by virtue of the fact that the stop elements provided on the pedal 12 and the seating, respectively, come into contact with each other. In this pre-determined resting position, the lower face of the front end part 16a of the frame 16 of the pedal 12 is spaced apart from the upper face of the end portion of the underlying rear arm 9a of the rocker 9 by a distance, or play, d. This free motion d is selected according to an order of magnitude of the standard tolerance for the thickness of the sole 6 of the boot, i.e., according to the difference between the maximum thickness e2 (FIG. 2) and the minimum thickness e1 (FIG. 1) accepted for the sole 6. In practice, for the sole 6 of a senior-type boot, the standard thickness is, for example, 19 mm, +or−1 mm, at the front end of the sole. Expressed differently, the minimal and maximal thicknesses e1 and e2 of the sole 6 are 18 and 20 mm, respectively. Accordingly, the play d between the front end 12a of the sole 12 and the end of the rear arm 9a of the rocker device 9 is approximately 2 mm.

The pedal 12 occupies its pre-determined resting position (illustrated in FIG. 1) when no boot is mounted on the ski. When the front of the boot 2 with a sole 6 of minimal thickness e1 is inserted in the front stop 1, the lower face of the sole 6 is tangent to the anti-friction plate 17, while the front end of the sole is inserted in the jaw 5 and the pedal 12 is not pushed back and downward from its resting position. However, if a vertical, downward pressure is exerted on the front of the boot, the pedal 12 is then lowered against the return force of the spring 19 until it comes into contact with the arm 9a of the rocker device.

The stiffness of the spring 19 is preferably chosen so as to push back clearly the sole of an empty ski boot against the sole-clamp 7a.

As shown in FIG. 2, when a boot 2 with a sole 6 of maximum thickness 32 is inserted in the front stop 1, the sole 6 then presses sufficiently on the pedal 12 so that the play d becomes zero, i.e., the front end 12a of the pedal 12 is just barely supported on the end of the rear arm 9a of the rocker device 9. Here again, this arrangement is not essential, and slight play d could also remain.

In the case a sole 6 having a thickness of between the maximum and minimum thicknesses e2 and e1, when the front stop is locked in place, the pedal 12 occupies an intermediate position, i.e., a reduced level of play between the maximum play d and zero play in the resting position exists between the front end 12a of the pedal 12 and the end of the rear arm 9a.

Of course, the resting height position of the pedal 12 depends on the distance between the rear arm 9a of the rocker device 9 and the upper surface of the ski. The shorter the distance i.e. the closer the rear arm 9a to the ski, the lower the front end 12a of the pedal 12 may be.

From the preceding description, it can thus be seen that the height-adjustment device is incorporated into the pedal 12 forming the forward fall sensor. When a forward fall occurs, the play between the front end of the pedal and the arm 9a of the rocker device 9 is eliminated, either because of the thickness of the sole or under the effect of the thrust the sole exerts on the pedal. The force generated by the boot on the pedal, indicated by the arrow f in FIGS. 1 and 2, is then transmitted to the rocker device 9 by its rear arm 9a, the rocker 9 then acting inside the front stop 1 to lower the lateral release threshold of the latter. If the sole 6 has the maximum thickness e2, as soon as it is depressed the pedal 12 immediately exerts force f on the rear arm 9a of the rocker 9, while if the sole possesses a thickness less than the maximum thickness e2 and if the pedal is not already supported on the arm 9a of the rocker, it must first take up the play d before pressing on the rocker 9. In other words, the pedal 12 must first take up the play d provided for height adjustment, before being able to affect the release threshold of the front stop. However, it must be emphasized that the stresses exerted by the boot on the pedal in the event of a forward fall are clearly greater than those generated during the height-adjustment phase.

Figure 3:
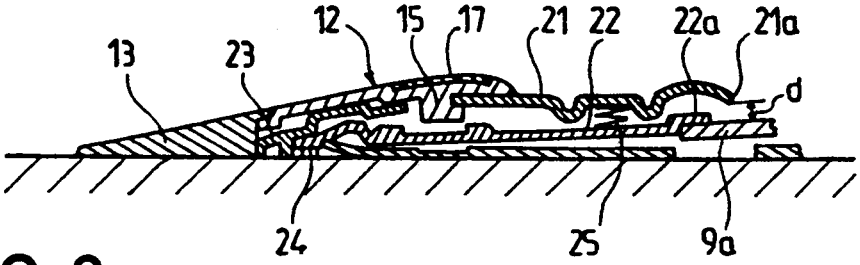
FIG. 3 is a vertical, longitudinal partial cross-section of a variant.

In the variant shown partially in FIG. 3, the pedal 12 comprises, beneath the upper support plate 15 carrying the anti-friction plate 17, two vertically independent movable elements, i.e., an upper plate 21 and a lower plate 22. The upper plate 21 is attached to the support plate 15 and is jointed by its rear end to the seating 13 around a horizontal, transverse axis 23. Its front end 21a is, in the resting position, at a distance d above the rear arm 9a of the rocker. The lower plate 22 is jointed at its front end to the seating 13 around a horizontal, transverse axis 24. Its front end 22a is permanently supported on the rear arm 9a of the rocker 9. A weak compression spring 25 is arranged between the front portions of the two plates 21 and 22 and tends to spread them apart. In this variant, the height adjustment is effected by varying the relative spacing between the two plates 21 and 22. To this end, the spring 25 is weaker than the spring 8 of the energy-generating mechanism. Accordingly, the spring 25 may become crushed by itself, in the first place when the sole of a boot 6 is inserted in the front stop and rests on the pedal, as a function of the thickness of the sole 6. In the case of a sole 6 having the minimum thickness el, the upper plate 21 occupies the position illustrated in FIG. 3, in which it is pushed upward by the spring 25 supported on the lower plate 22. On the other hand, if the sole 6 has the maximum thickness e2, this sole, by resting on the anti-friction plate 17, causes the upper plate 21 to be pressed down on the lower plate 22, so that its end 21*a* barely contacts the rear arm 9*a*. Beginning at this moment, the forward fall-compensation mechanism may be activated.

What is claimed is:

1. Safety ski binding designed to hold releasibly in place the front of a boot (2) mounted on the ski (3), comprising a body (4) attached to said ski and having a rear portion carrying a boot position-retention jaw (5) incorporating two lateral position-retention wings located opposite each other (7), an energy-generating mechanism (8) housed in said body and for returning said jaw elastically to a locked position, and a forward fall-compensation mechanism comprising a forward fall-sensor pedal (12) mounted on said ski to the rear of a front stop (1), said pedal having a rear portion jointed to a seating (13) attached to said ski for pivoting movement about a horizontal, transverse axis (14,23), said pedal being returned upward to a predetermined rest position by a spring (19,25) and having a forward extension (18) which, in the event that the skier falls forward, exerts a downward force on a movable control element belonging to the forward fall-compensation mechanism and housed in said body (4) of said front stop so as to lower a release threshold of said front stop, wherein a front end (12*a*,21*a*) of said pedal (12) is, in said predetermined rest position, located at a distance (d) above said movable control element (9) which approximates a standard tolerance for the thickness of a sole (6) of said boot, said tolerance being equal to a standard distance between maximum (e2) and minimum (e1) thicknesses of said sole 6.

2. Safety binding according to claim 1, wherein said rest position of said pedal (12) is the same both when no boot is mounted on the ski and when the front of a boot (2) having a sole (6) of minimal thickness (e1) is inserted in said front stop (1).

3. Safety binding according to claim 1, wherein said pedal (12) comprises an upper support plate (15) made of molded plastic and carrying an anti-friction plate (17), and an underlying metal frame (16) attached to said support plate and having a rear end incorporating a transverse part forming the pivoting axis (14 of said pedal (12), said upper support plate (15) comprising said forward extension (18) constituted by a substantially horizontal tongue, said frame (16) of said pedal extending forward beneath said tongue (18), and said spring (19) exerting upward stress on said pedal (12) being arranged between said seating (13) of said pedal and a front portion of said frame (16).

4. Safety binding according to claim 1, wherein said pedal (12) comprises an upper support plate (15) carrying an anti-friction plate (17) and, beneath said upper support plate, two plates vertically movable independently of one another, said two plates including an upper plate (21) and a lower plate (22), said upper plate (21) being attached to said support plate (15) and having a rear end jointed to said seating (13) around a horizontal, transverse axis (23), a front end (21*a*) of said upper plate being, in rest position, at a distance (d) above said movable control element (9), said lower plate (22) having a rear end jointed to said seating (13) around a horizontal, transverse axis (24), a front end of said lower plate (22*a*) being permanently supported on the rear end of said movable control element (9), said spring (25) being arranged between the front portions of said two plates (21,22) so as to space them apart.

* * * * *

UNITED STATES PATENT AND TRADEMARK OFFICE

CERTIFICATE OF CORRECTION

PATENT NO. : 5,344,180

DATED : September 6, 1994

INVENTOR(S) : Bruno Lancon et al

It is certified that error appears in the above-indentified patent and that said Letters Patent is hereby corrected as shown below:

On the cover page, item [73], should read
--Salomon S.A., Annecy, France--.

Signed and Sealed this

Twenty-fifth Day of April, 1995

*Attest:*

Bruce Lehman

BRUCE LEHMAN

*Attesting Officer*

*Commissioner of Patents and Trademarks*